US008257043B2

(12) United States Patent
Kuroki et al.

(10) Patent No.: US 8,257,043 B2
(45) Date of Patent: Sep. 4, 2012

(54) MULTIBLADE IMPELLER

(75) Inventors: Kensuke Kuroki, Shizuoka (JP); Tatsunori Nishihara, Minamiashigara (JP); Kouji Wada, Fujikawa (JP); Hideharu Tanaka, Shizuoka (JP); Toshimasa Hiraoka, Yaizu (JP); Tsuyoshi Morii, Tsubame (JP)

(73) Assignees: Hitachi Industrial Equipment Systems Co., Ltd., Tokyo (JP); Koshin Industries Co., Ltd., Niigata (JP)

( * ) Notice: Subject to any disclaimer, the term of this patent is extended or adjusted under 35 U.S.C. 154(b) by 1425 days.

(21) Appl. No.: 11/757,439

(22) Filed: Jun. 4, 2007

(65) Prior Publication Data

US 2008/0089784 A1 Apr. 17, 2008

(30) Foreign Application Priority Data

Oct. 12, 2006 (JP) ..... 2006-278531

(51) Int. Cl.
*F04D 29/28* (2006.01)
*F04D 29/38* (2006.01)

(52) U.S. Cl. ..... 416/186 R; 416/236 R

(58) Field of Classification Search ..... 416/186 R, 416/236 R, 209; 29/889.4
See application file for complete search history.

(56) References Cited

U.S. PATENT DOCUMENTS 1,352,848 A * 9/1920 Stanyo ..... 416/238
2,272,695 A * 2/1942 Addison ..... 416/187
2,767,906 A * 10/1956 Doyle ..... 416/186 R
4,025,231 A * 5/1977 Kochevar et al. ..... 416/144
4,120,084 A * 10/1978 Wallman ..... 29/509
6,220,818 B1 * 4/2001 Andulics et al. ..... 416/178
6,368,062 B1 * 4/2002 Yagami et al. ..... 416/178
6,929,452 B1 * 8/2005 Pargeter et al. ..... 416/186 R

FOREIGN PATENT DOCUMENTS

| | | | |
|---|---|---|---|
| JP | 60-093200 | | 5/1985 |
| JP | 61049193 A | * | 3/1986 |
| JP | 01-115892 | | 8/1989 |
| JP | 07-127598 | | 5/1995 |
| JP | 08-319992 | | 12/1996 |
| JP | 2000-291589 | | 10/2000 |
| JP | 2001-124019 | | 5/2001 |

OTHER PUBLICATIONS

Official Action dated Sep. 27, 2011, for Japanese Patent Application No. 2006-278531; 4 pages; Japanese Patent Office, Japan.
Communication mailed May 29, 2012, for Japanese Patent Application No. 2006-278531; 3 pages; Japanese Patent Office, Japan.

* cited by examiner

*Primary Examiner* — Edward Look
*Assistant Examiner* — Ryan Ellis
(74) *Attorney, Agent, or Firm* — Antonelli, Terry, Stout & Kraus, LLP.

(57) ABSTRACT

The multiblade impeller of the present invention comprises a main plate, a side plate having a suction port at a center thereof, and a large number of blades provided between the main plate and the side plate and extend in the radial direction in an arc form. The main plate and the side plate each have a large number of ridge portions, each extending in the radial direction in an arc form so as to coincide with the shape of the blade extending in the radial direction in an arc form. End portions of the blades are inserted in grooves formed inside the ridge portions of the main plate and the side plate and are fixed to the ridge portions by being bent.

8 Claims, 11 Drawing Sheets

MULTIBLADE IMPELLER

INCORPORATION BY REFERENCE

The present application claims priority from Japanese application JP2006-278531 filed on Oct. 12, 2006, the content of which is hereby incorporated by reference into this application.

BACKGROUND OF THE INVENTION

The present invention relates to a multiblade impeller and, more particularly, to a multiblade impeller suitable for industrial machinery, air conditioning equipment, and the like.

Conventionally, a multiblade impeller comprising a main plate, a side plate and a plurality of blades generally has a fixing structure for fixing the blades to the main plate and side plate, in which projecting pieces provided at end portions of the blade are inserted in blade mounting holes provided in flat portions of the main plate and side plate, and the projecting pieces are bent to fix the blade to the main plate and side plate so as to press the main plate and side plate down.

Regarding the fixing structure for fixing the blades to the main plate and side plate, the conventional multiblade impellers have been disclosed, for example, in JP-A-60-93200, JP-A-8-319992 and JP-A-7-127598.

In the multiblade impeller disclosed in JP-A-60-93200, a blade fixing insertion piece is provided in a joint portion between a blade and a side plate having a blade mounting hole, and the insertion piece is deformed to pressingly fix the blade and the side plate.

In the multiblade impeller disclosed in JP-A-8-319992, a plastic or brazing metal is filled in joint portions between a main plate/side plate and a blade to fix the blade to the main plate and the side plate.

In the multiblade impeller disclosed in JP-A-7-127598, protrusions are provided on side surfaces of a blade, and the protrusions are closely fitted in fitting grooves in a main plate and a side plate to fix the blade to the main plate and the side plate.

In the general fixing structure of the above-described conventional multiblade impeller, when the main plate, side plate and blades are thin, a high fixing strength cannot be obtained, and hence sufficient reliability cannot be attained. Therefore, there is need to increase their thickness, which leads to an increase in cost.

Also, since the main plate, the side plate and the blades are of a simple plate shape, a rigidity necessary for an impeller cannot be obtained unless the thicknesses thereof are increased. As a result thereof, there is a problem that the weight of the multiblade impeller increases to affect performance of products in which such multiblade impellers are used. In other words, since the multiblade impeller generally repeats start and stop, it is desired to facilitate the start and stop of the multiblade impeller and hence to improve the performance of the product in which the multiblade impeller is used by decreasing the weight of the multiblade impeller, and further it is desired to improve the reliability of the product in which the multiblade impeller is used by decreasing a load to be applied to driving system of the multiblade impeller. In particular, in recent years, since the rotational speed control of the multiblade impeller has been implemented by an inverter, it is desired to improve the response of rotational speed control and hence to improve the performance of the product in which the multiblade impeller is used by decreasing the weight of the multiblade impeller.

In the above-described multiblade impeller disclosed in JP-A-60-93200, because of the fixing structure in which the blade fixing insertion piece is provided in the joint portion between the blade and the side plate having the blade mounting hole, and the insertion piece is deformed to press the blade and the side plate, the blade fixing insertion piece is needed, and also troublesome work for deforming the blade fixing insertion piece along the blade is necessary, which results in an increase in cost. In the multiblade impeller disclosed in JP-A-60-93200 as well, since the main plate, the side plate and the blades are of a simple plate shape, rigidity necessary for an impeller cannot be obtained unless the thicknesses thereof are increased, so that the multiblade impeller disclosed in JP-A-60-93200 has a problem similar to that of the above-described general fixing structure.

In the above-described multiblade impeller disclosed in JP-A-8-319992, because of the fixing structure in which plastic or brazing metal is filled in the joint portions between the main plate/side plate and the blade to fix the blade to the main plate and the side plate, the brazing material is needed, and also troublesome work for filling the brazing material in the joint portions is necessary, which results in an increase in cost. In the multiblade impeller disclosed in JP-A-8-319992 as well, since the main plate, the side plate and the blades are of a simple plate shape, rigidity necessary for an impeller cannot be obtained unless the thicknesses thereof are increased, so that the multiblade impeller disclosed in JP-A-8-319992 has a problem similar to that of the above-described general fixing structure.

In the above-described multiblade impeller disclosed in JP-A-7-127598, although the blade can be closely fitted in the fitting grooves in the main plate and the side plate by the protrusions provided on the side surfaces of the blade, the main plate, the side plate and the blades are substantially of a simple plate shape. Therefore, rigidity necessary for an impeller cannot be obtained unless the thicknesses of the main plate, the side plate and the blades are increased, so that the multiblade impeller disclosed in JP-A-7-127598 has a problem similar to that of the above-described general fixing structure.

SUMMARY OF THE INVENTION

The present invention has been made to solve the above-described problems, and accordingly an object thereof is to obtain a multiblade impeller having a main plate and a side plate having high fixing strength between the main plate/side plate and the blades and high rigidity, which is low in cost, light in weight, and moreover high in reliability, and capable of improving the performance of a product in which the multiblade impeller is used.

To achieve the above object, the present invention provides a multiblade impeller comprising a main plate, a side plate having a suction port in a center thereof, and a large number of blades that are provided between the main plate and the side plate and extend in a radial direction in an arc form, wherein the main plate and the side plate each has a large number of ridge portions extending in the radial direction in an arc form so as to coincide with the shape of the blade extending in the radial direction in an arc form; and end portions of the blades are inserted in grooves formed inside of the ridge portions of the main plate and the side plate, and are fixed to the ridge portions by being bent.

More favorable specific configuration examples of the present invention are as follows:

(1) The end portions of the blade are fixed in the ridge portions of the main plate and the side plate by being bent together with the ridge portions.

(2) The ridge portions of the main plate and the side plate have a plurality of locking holes positioned at top portions thereof and provided in the radial direction, and the end portions of the blades have a plurality of locking projecting pieces that pass through the locking holes to be bent, and are fixed to the ridge portions in contact with the locking holes and inlet sides of the grooves.

(3) A gap is provided between a tip end portion of the locking projecting piece provided in the end portion of the blade and the main plate/the side plate.

(4) The plurality of locking projecting pieces in the end portion of the blade that are caused to pass through the locking holes in the ridge portion are bent in opposite directions to each other.

(5) The shape on an inside diameter side of the blade is made a straight line connecting a position of the groove of the main plate to a position of the groove of the side plate.

(6) A reinforcing rib is formed at a place at which the blade overhangs farthest from the straight line connecting the position of the groove of the main plate to the position of the groove of the side plate on the inside diameter side of the blade.

(7) Longitudinal and transverse reinforcing ribs are formed in the blade.

(8) A hub is provided at a central portion of the main plate, caulking convex portions are provided in the hub, slits are provided in the main plate, the main plate is press fitted into the caulking convex portions of the hub and the caulking convex portions are crushed so that the hub and the main part is joined.

According to the present invention configured as described above, there can be obtained a multiblade impeller having a main plate and a side plate having a high fixing strength between the main plate/side plate and blades and high rigidity, which is low in cost, light in weight, and moreover high in reliability, and capable of improving the performance of a product in which the multiblade impeller is used.

Other objects, features and advantages of the invention will become apparent from the following description of the embodiments of the invention taken in conjunction with the accompanying drawings.

DETAILED DESCRIPTION OF THE PREFERRED EMBODIMENTS

Figure 1:
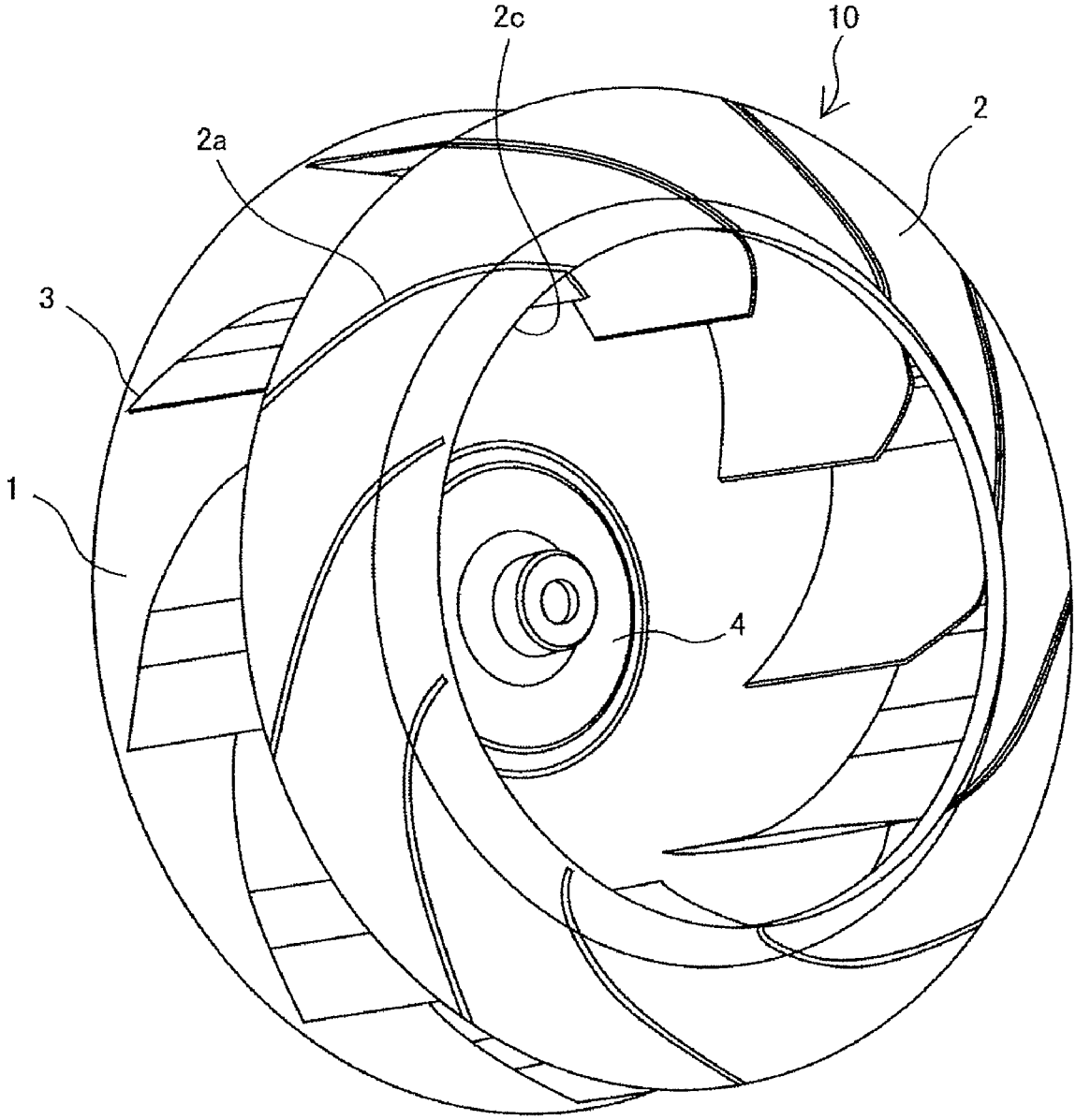
FIG. 1 is a perspective view of a multiblade impeller in accordance with a first embodiment of the present invention.

Embodiments of the present invention will now be described with reference to the accompanying drawings. The same reference numerals in the drawings of the embodiments denote the same or equivalent elements.

Figure 2:
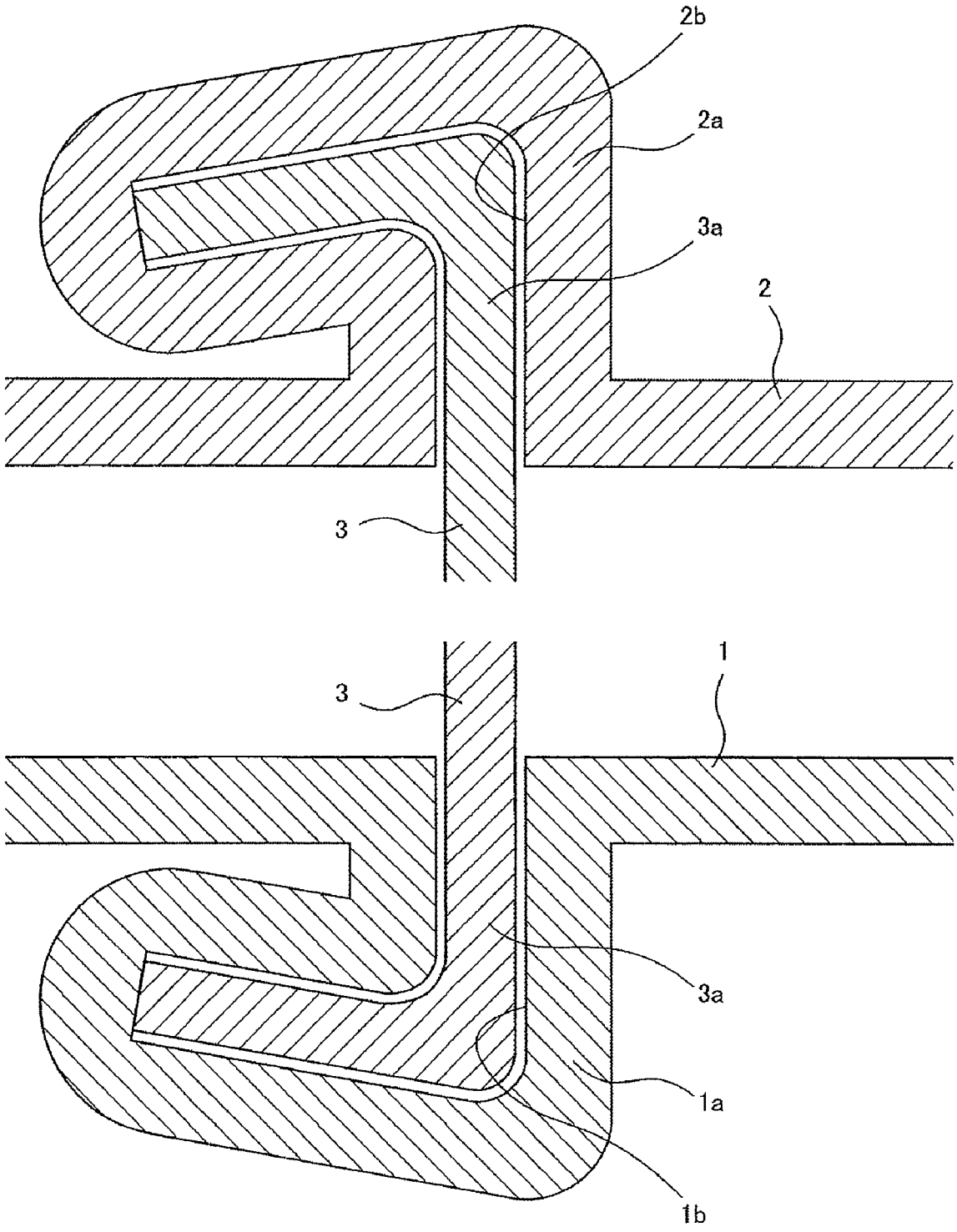
FIG. 2 is an enlarged sectional view of a fixing portion between a main plate/side plate and a blade of the first embodiment.
Figure 3:
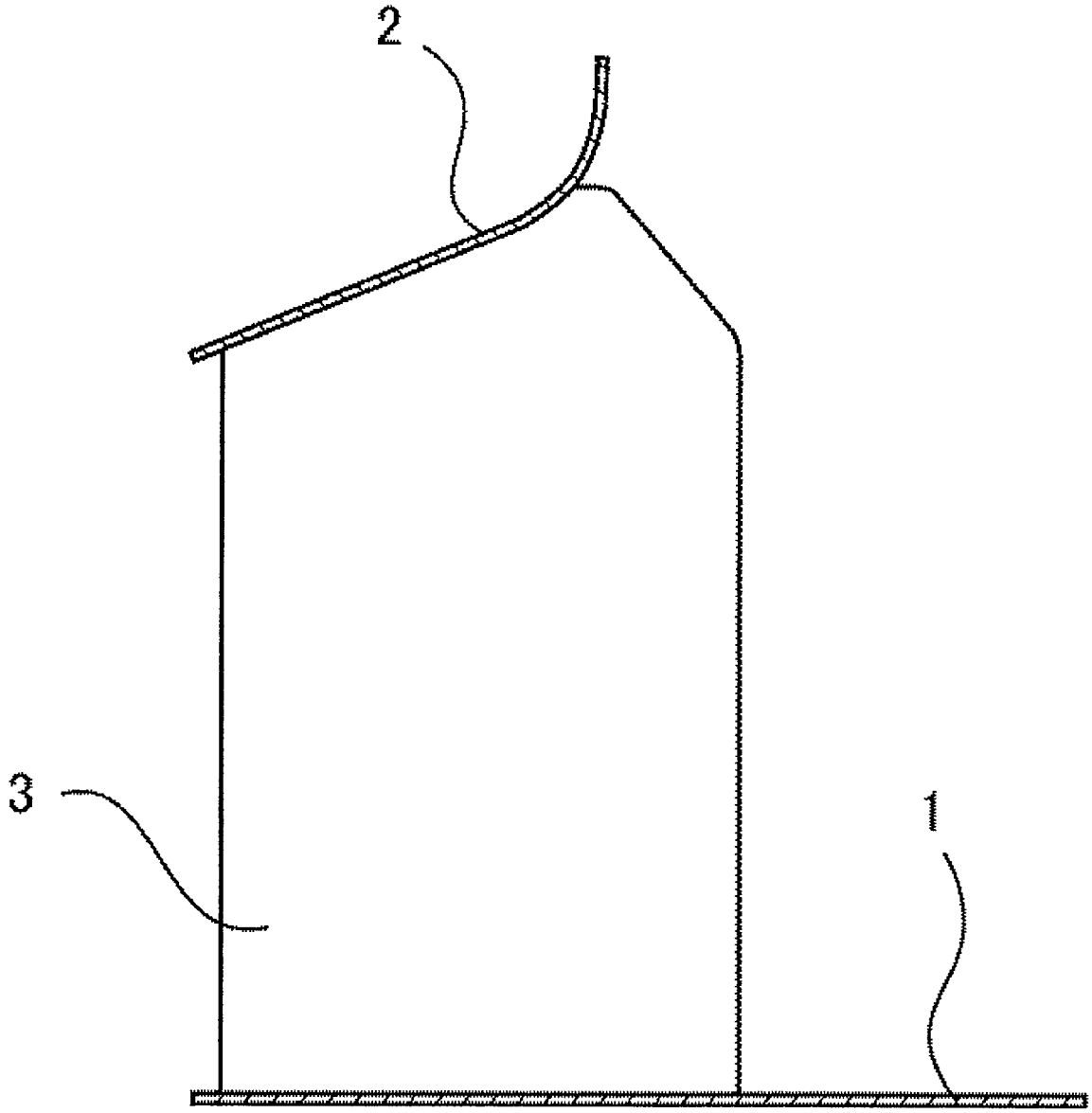
FIG. 3 is a sectional view of a part, showing a shape of a blade of the first embodiment.

A multiblade impeller in accordance with a first embodiment of the present invention is described with reference to FIGS. 1 to 3. FIG. 1 is a perspective view of a multiblade impeller 10 in accordance with the first embodiment of the present invention, FIG. 2 is an enlarged sectional view of a fixing portion between a main plate/side plate and a blade of the first embodiment, and FIG. 3 is a sectional view of a part, showing the shape of the blade of the first embodiment. The multiblade impeller 10 in this first embodiment is an example of multiblade impeller used for a turbofan.

The multiblade impeller 10 comprises a main plate 1, a side plate 2 having a suction port 2*c* at a center thereof, a large number of blades 3 that are provided between the main plate 1 and the side plate 2 and extend in the radial direction in an arc form, and a hub 4 attached to a central part of the main plate 1. By the rotation of the multiblade impeller 10, air is sucked from the suction port 2*c* of the side plate 2, and is blown out of an outer periphery of the blade 3.

The main plate 1 has a plurality of ridge portions 1*a* each extending in the radial direction in an arc form so as to coincide with the shape of the blade 3 extending in the radial direction in an arc form, and the number of ridge portions 1*a* is equal to the number of blades 3. The side plate 2 has a plurality of ridge portions 2*a* each extending in the radial direction in an arc form so as to coincide with the shape of the blade 3 extending in the radial direction in an arc form, and the number of ridge portions 2*a* is equal to the number of blades 3.

End portions 3*a* of the blade 3 are inserted in grooves 1*b* and 2*b* formed inside the ridge portions 1*a* and 2*a* of the main plate 1 and the side plate 2, respectively, and are fixed to the ridge portions 1*a* and 2*a* by being bent. According to this configuration, since the end portion 3*a* of the blade 3 is fixed to the ridge portion 1*a*, 2*a* having higher strength, high fixing strength can be obtained even if the thicknesses of the main plate 1, the side plate 2 and the blades 3 are decreased, so that the multiblade impeller 10 can be made low in cost, light in weight, and moreover high in reliability. Also, since the rigidity of the main plate 1 and the side plate 2 is increased by the ridge portions 1*a* and 2*a* thereof, the thicknesses of the main plate 1 and the side plate 2 can be decreased, so that the weight of the multiblade impeller 10 can be reduced. Thereby, it is possible to facilitate the start and stop of the multiblade impeller 10 and hence to improve the performance of a product in which the multiblade impeller is used, and further it is possible to improve the reliability of the product in which the multiblade impeller is used by decreasing a load to be applied to a driving system of the multiblade impeller. In the case where the rotational speed of the multiblade impeller 10 is controlled by an inverter, the response of rotational speed control is improved, and hence the performance of the product in which the multiblade impeller is used can be improved.

In this embodiment, the end portions 3*a* of the blades 3 are fixed in the ridge portions 1*a*, 2*a* of the main plate 1 and the side plate 2 by being inserted in the grooves 1*b*, 2*b* in a state in which the ridge portions 1*a*, 2*a* are formed in a vertical state by press forming and by being bent together with the ridge portions 1*a*, 2*a* of the main plate 1 and the side plate 2. By this configuration, a far higher fixing strength between the main plate 1/side plate 2 and the blade 3 can be achieved.

Figure 4:
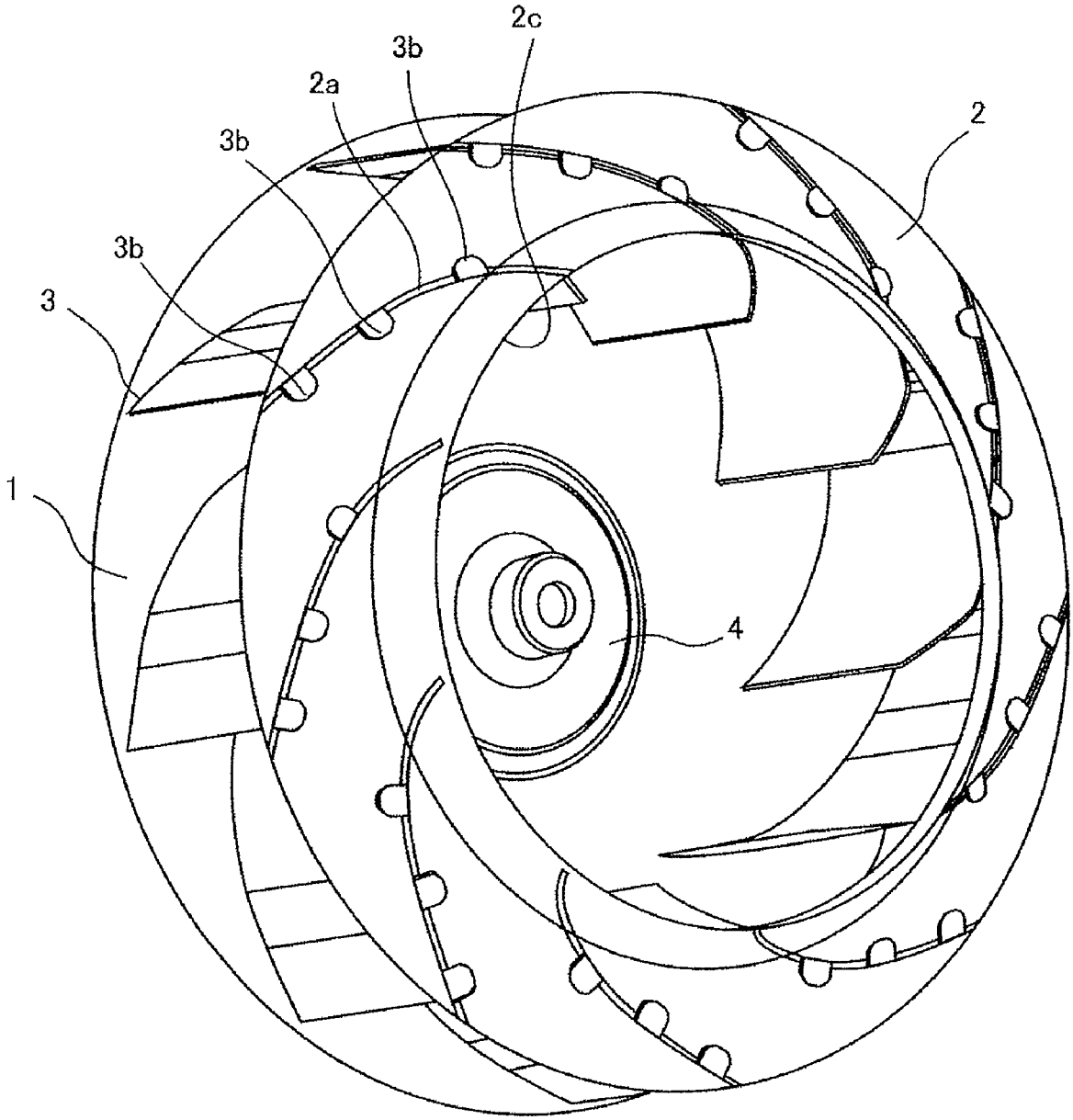
FIG. 4 is a perspective view of a multiblade impeller in accordance with a second embodiment of the present invention.
Figure 5:
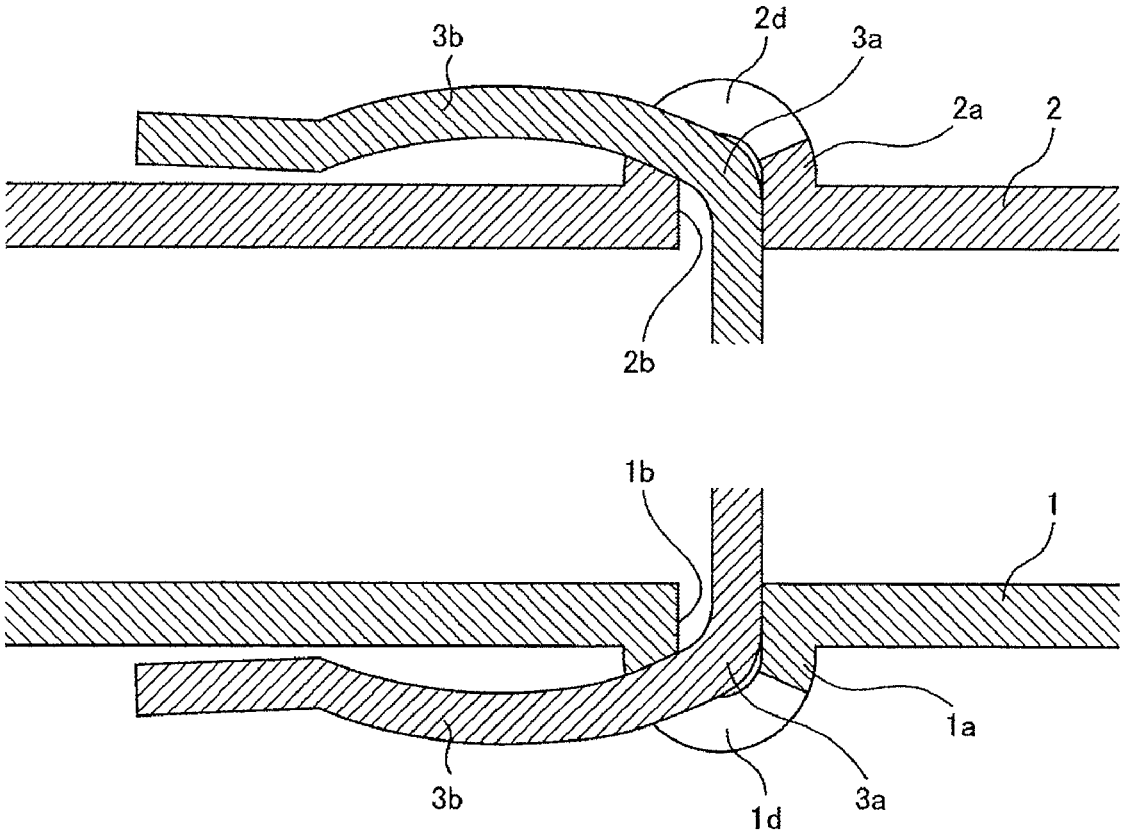
FIG. 5 is an enlarged sectional view of a fixing portion between a main plate/side plate and a blade of the second embodiment.

Next, the multiblade impeller 10 in accordance with a second embodiment of the present invention is described with reference to FIGS. 4 and 5. FIG. 4 is a perspective view of the multiblade impeller 10 in accordance with the second embodiment of the present invention, and FIG. 5 is an enlarged sectional view of a fixing portion between the main plate/side plate and the blade of the second embodiment. The configuration of the multiblade impeller 10 of this embodiment is basically the same as that of the multiblade impeller 10 of the first embodiment except the point described below, so that the duplicated explanation is omitted.

In the second embodiment, the ridge portions 1*a* and 2*a* of the main plate 1 and the side plate 2 have a plurality of locking holes 2*d* that are positioned at top portions of the main plate 1 and the side plate 2 and are provided in the radial direction. The end portions 3*a* of the blades 3 have a plurality of locking projecting pieces 3*b* that pass through the locking holes 2*d* and are bent, and are fixed to the ridge portions 1*a*, 2*a* in contact with the locking holes 2*d* and inlet side of the grooves 2*b*. By this configuration, high fixing strength and high rigidity can be obtained by simple work of bending the locking projecting pieces 3*b* even if the thicknesses of the main plate 1, the side plate 2 and the blades 3 are decreased. Therefore, an advantage that the multiblade impeller 10 can be made low in cost, light in weight, and moreover high in reliability can be achieved, which advantage is the same as that of the first embodiment.

Also, in the second embodiment, gaps are provided between tip end portions of the locking projecting pieces 3*b* provided at the end portions 3*a* of the blades 3 and the main plate 1/the side plate 2. Thereby, when the multiblade impeller 10 is rotated, the occurrence of noise, vibrations, and damage caused by the contact between the locking projecting pieces 3*b* and the main plate 1/the side plate 2 can be prevented.

Further, in the second embodiment, the locking projecting pieces 3*b* at the end portions 3*a* of the blades 3 that are caused to pass through the locking holes 2*d* in the ridge portions 1*a*, 2*a* are bent in the direction opposite to each other. Thereby, a far higher fixing strength between the main plate 1/side plate 2 and the blade 3 can be achieved.

Figure 6:
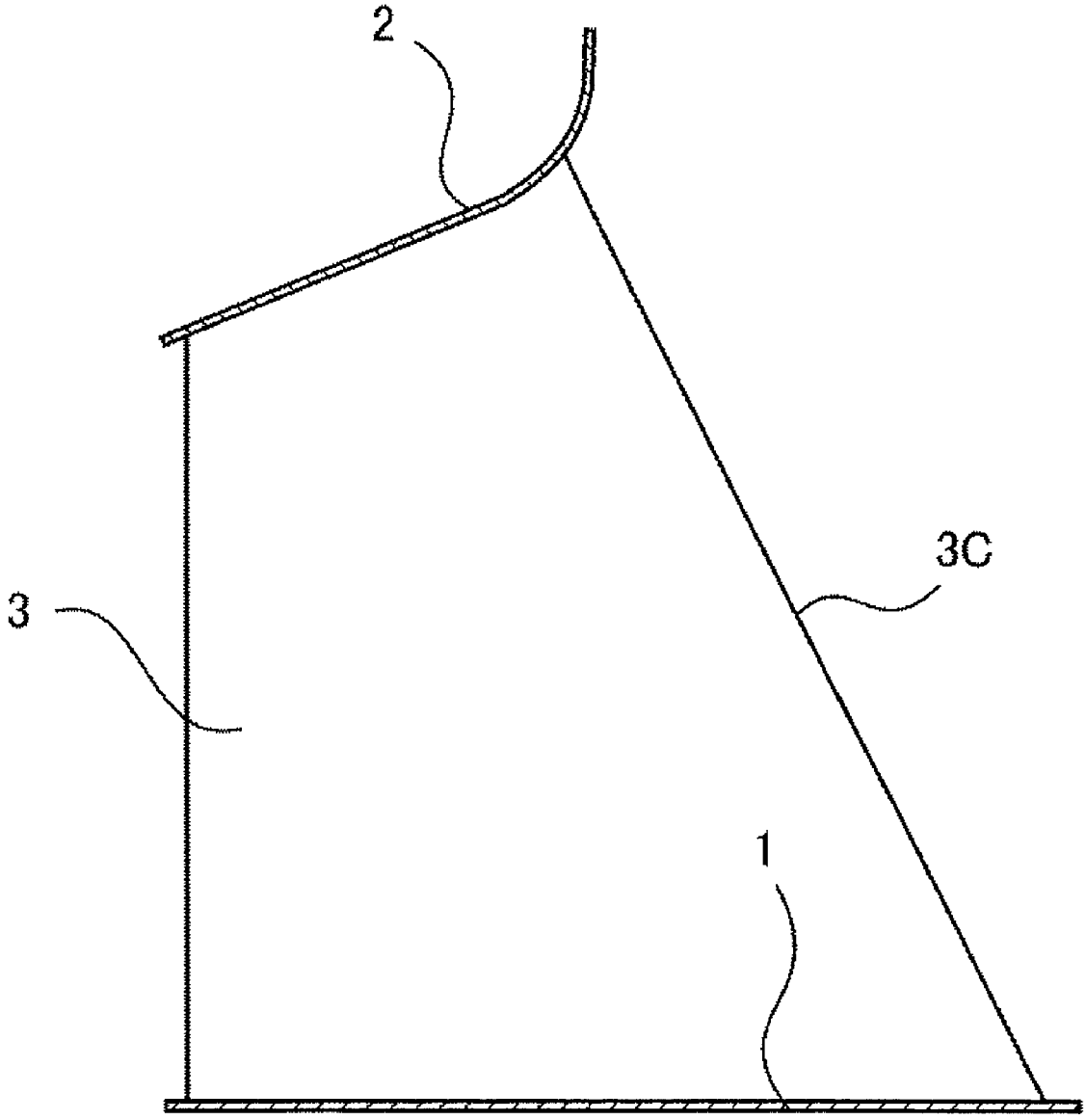
FIG. 6 is a sectional view of a part, showing a shape of a blade of a multiblade impeller in accordance with a third embodiment of the present invention.
Figure 7:
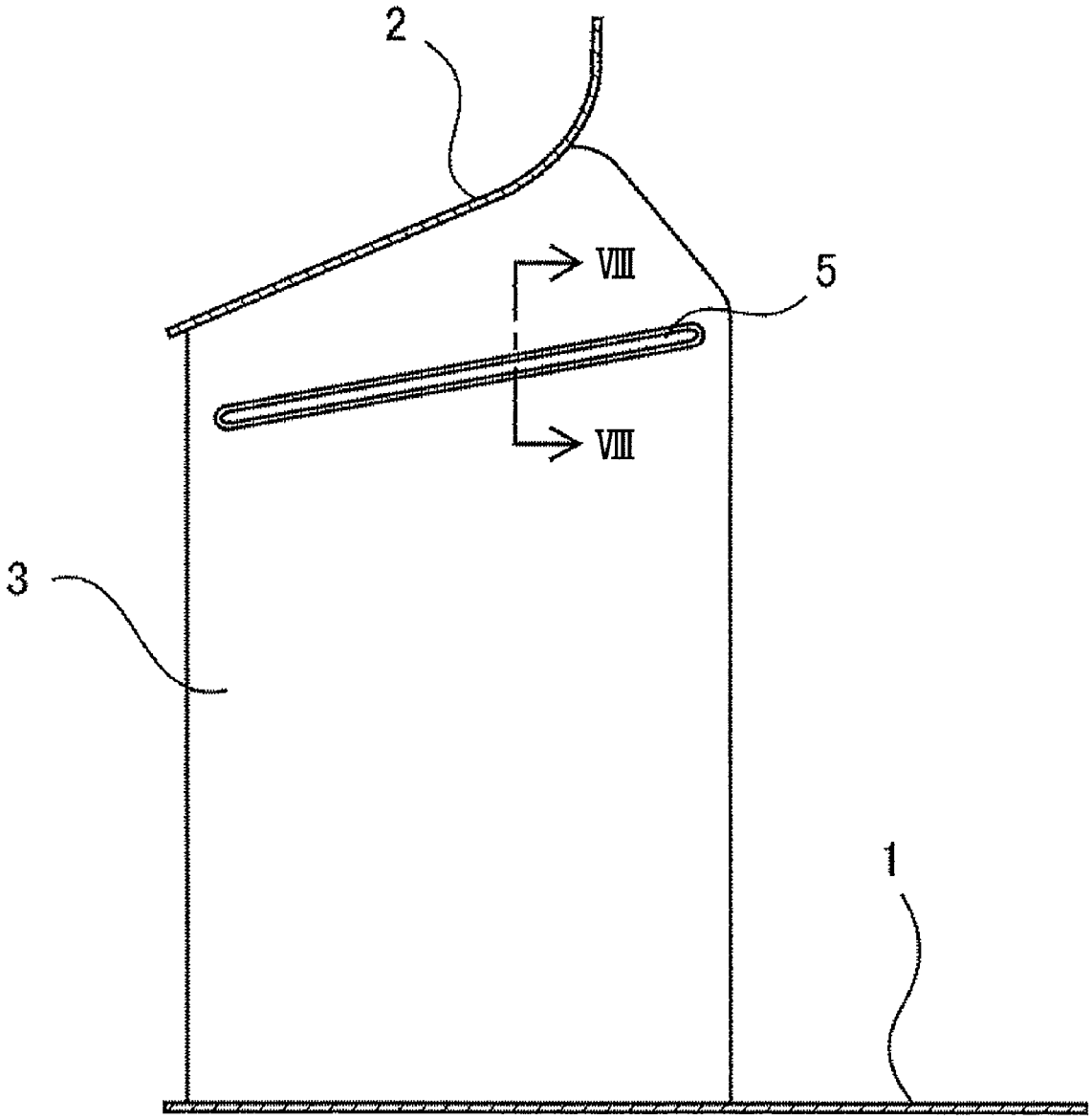
FIG. 7 is a sectional view of a part, showing the shape of a blade of a multiblade impeller in accordance with a fourth embodiment of the present invention.
Figure 8:
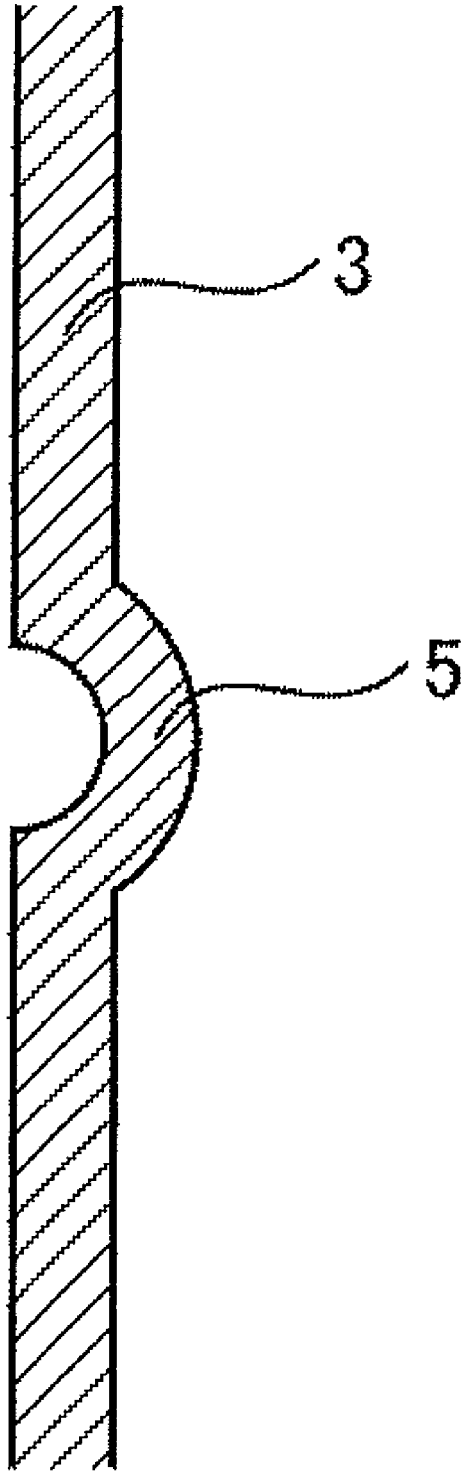
FIG. 8 is a sectional view taken along the line VIII-VIII in FIG. 7.
Figure 9:
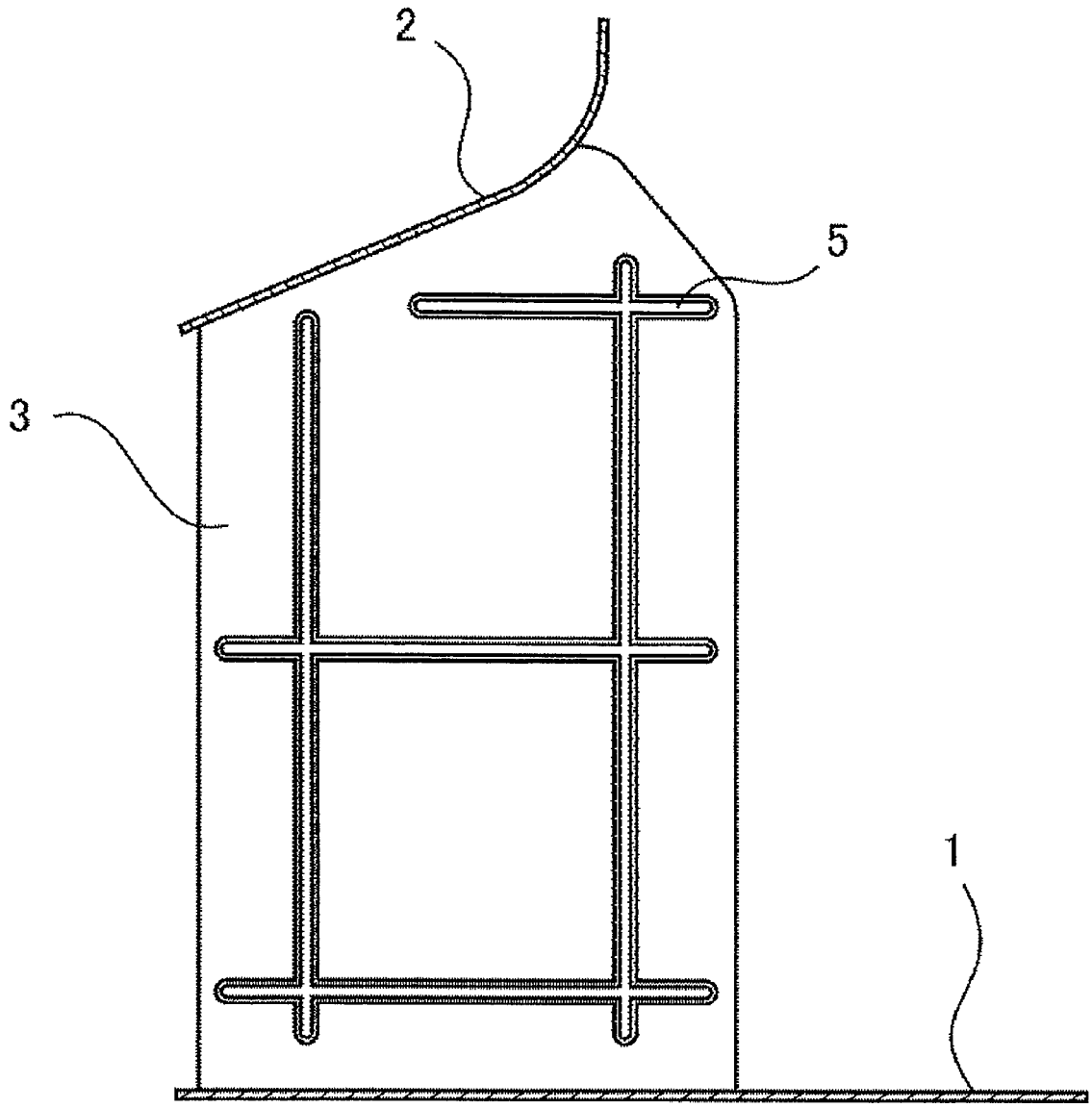
FIG. 9 is a sectional view of a part, showing the shape of a blade of a multiblade impeller in accordance with a fifth embodiment of the present invention.
Figure 10:
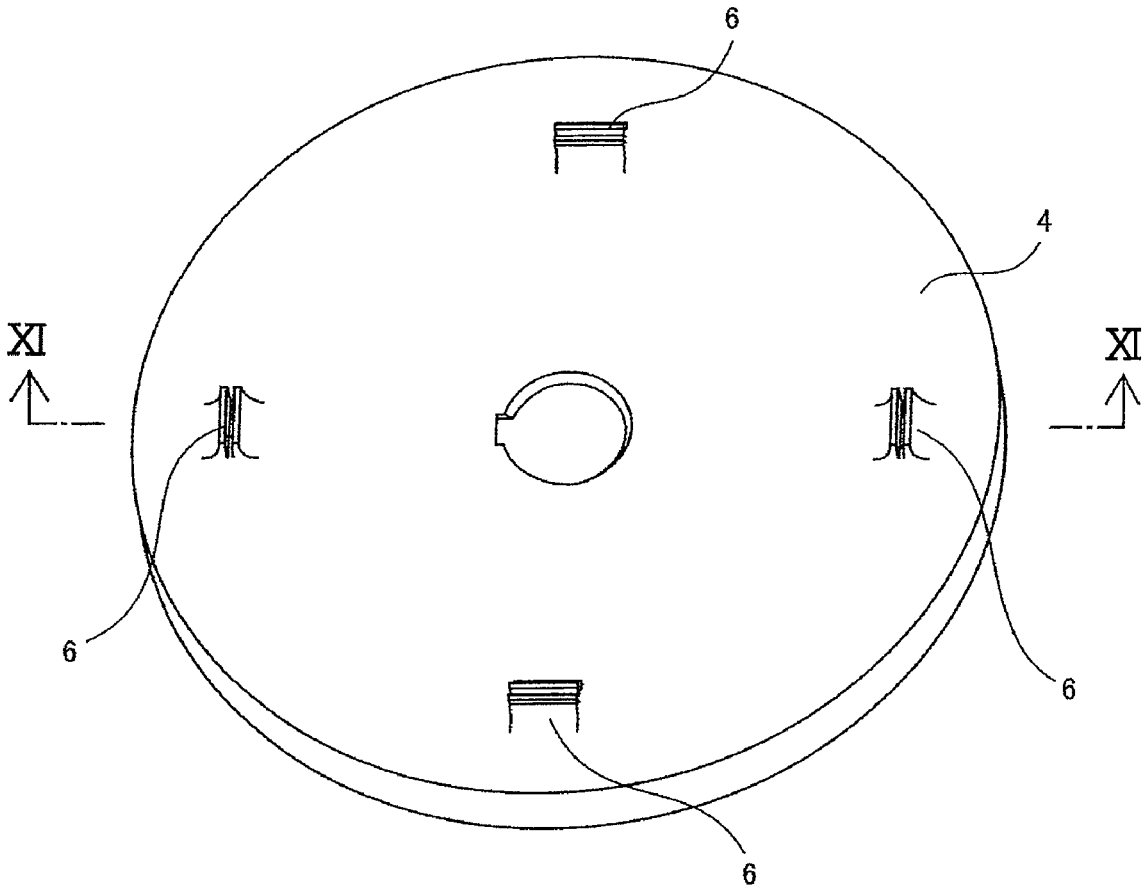
FIG. 10 is a perspective view of a hub of a multiblade impeller in accordance with a sixth embodiment of the present invention.
Figure 11:
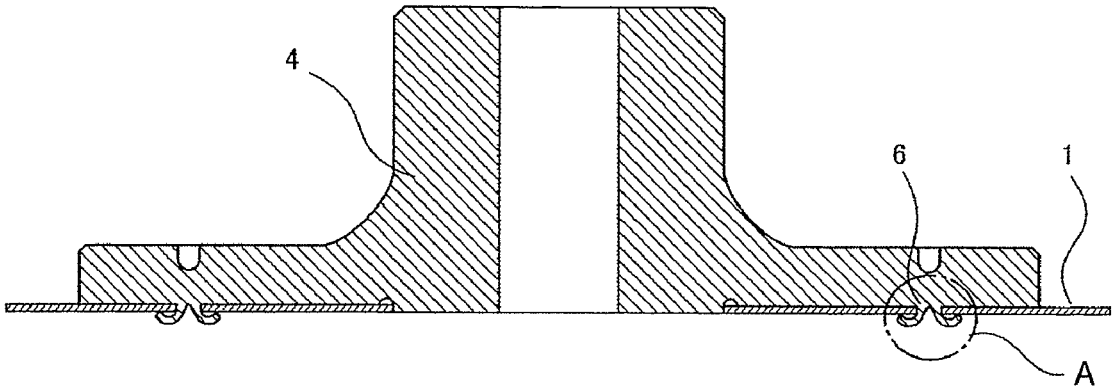
FIG. 11 is a sectional view taken along the line XI-XI in FIG. 10.
Figure 12:
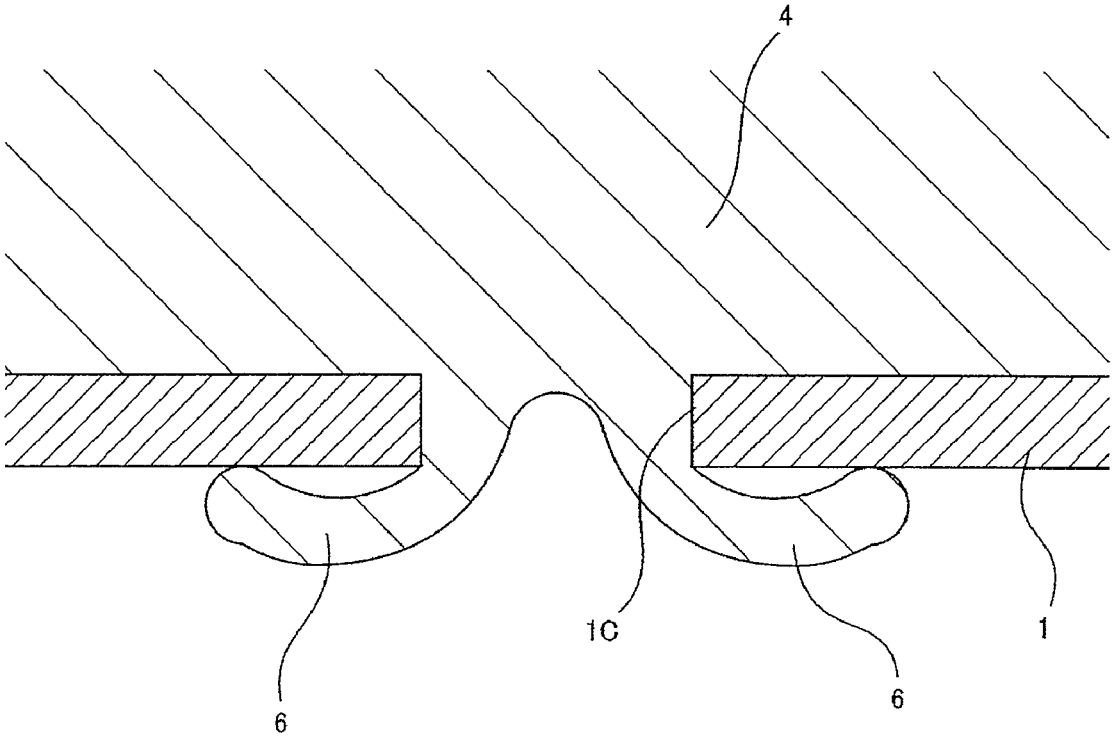
FIG. 12 is an enlarged view of portion A in FIG. 11.

Next, third to sixth embodiments of the present invention are described with reference to FIGS. 6 to 12. FIG. 6 is a sectional view of a part, showing the shape of the blade of the multiblade impeller in accordance with the third embodiment of the present invention, FIG. 7 is a sectional view of a part, showing the shape of the blade of the multiblade impeller in accordance with the fourth embodiment of the present invention, FIG. 8 is a sectional view taken along the line VIII-VIII in FIG. 7, FIG. 9 is a sectional view of a part, showing the shape of the blade of the multiblade impeller in accordance with the fifth embodiment of the present invention, FIG. 10 is a perspective view of the hub of the multiblade impeller in accordance with the sixth embodiment of the present invention, FIG. 11 is a sectional view taken along the line XI-XI in FIG. 10, and FIG. 12 is an enlarged view of portion A in FIG. 11. The configurations of the multiblade impellers 10 of the third to sixth embodiments are basically the same as that of the multiblade impeller 10 of the first embodiment or the corresponding embodiment except the points described below.

In the third embodiment, to enhance the rigidity of the blade 3, the blade shape on the inside diameter side of the blade 3 is made an end face 3*c* obtained by connecting a position of the groove of the main plate 1 to a position of the groove of the side plate 2 by a straight line.

In the fourth embodiment, to enhance the rigidity of the blade 3, a reinforcing rib 5 is formed at a place at which the blade shape overhangs farthest from the straight line connecting the groove position of the main plate 1 to the groove position of the side plate 2 on the inner diameter side of the blade 3.

In the fifth embodiment, to further enhance the rigidity of the blade 3, the reinforcing ribs 5 are formed in the longitudinal and transverse directions of the blade 3.

In the sixth embodiment, as shown in FIG. 10, caulking convex parts 6 are provided on the hub 4, the caulking convex parts 6 are press fitted in slits 1*c* formed in the main plate 1, and the caulking convex parts 6 are crushed as shown in FIGS. 11 and 12. Thereby, a strong joining between the main plate 1 and the hub 4 can be obtained.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A multiblade impeller comprising a main plate, a side plate having a suction port at a center thereof, and a plurality of blades that are provided between the main plate and the side plate and extend in a radial direction in an arc form, wherein the main plate and the side plate each have a plurality of ridge portions extending in the radial direction in an arc form so as to coincide with the shape of the blades extending in the radial direction in an arc form; and end portions of the blades are inserted in grooves formed inside the ridge portions of the main plate and the side plate, and are fixed to the ridge portions by being bent, wherein a hub is provided at a central portion of the main plate, caulking convex portions are provided in the hub, slits are provided in the main plate, the main plate is press fitted into the caulking convex portions of the hub and the caulking convex portions are crushed so that the hub and the main part is joined.

2. The multiblade impeller according to claim 1, wherein the ridge portions of the main plate and the side plate have a plurality of locking holes positioned at top portions thereof and provided in the radial direction, and the end portions of the blades have a plurality of locking projecting pieces that pass through the locking holes and are bent, and are fixed to the ridge portions in contact with the locking holes and inlet sides of the grooves.

3. The multiblade impeller according to claim 2, wherein gaps are provided between tip end portions of the locking projecting pieces provided at the end portions of the blades and the main plate, and gaps are provided between tip end portions of the locking projecting pieces provided at the end portions of the blades and the side plate.

4. The multiblade impeller according to claim 2, wherein the plurality of locking projecting pieces at the end portions of the blades that are caused to pass through the locking holes in the ridge portions are bent in a direction opposite to each other.

5. The multiblade impeller according to claim 1, wherein at least one reinforcing rib is formed in each blade, the at least one reinforcing rib not extending to an edge of each blade.

6. The multiblade impeller according to claim 1, wherein reinforcing ribs are formed in longitudinal and transverse directions of each blade.

7. The multiblade impeller according to claim 1, wherein a number of ridge portions on the main plate is equal to a number of blades, and a number of ridge portions on the side plate is equal to the number of blades.

8. A turbofan comprising the multiblade impeller of claim 1.

* * * * *